US005216718A

United States Patent [19]

Fukuda

[11] Patent Number: 5,216,718

[45] Date of Patent: Jun. 1, 1993

[54] METHOD AND APPARATUS FOR PROCESSING AUDIO SIGNALS

[75] Inventor: Mitsuyoshi Fukuda, Ora, Japan

[73] Assignee: Sanyo Electric Co., Ltd., Osaka, Japan

[21] Appl. No.: 690,213

[22] Filed: Apr. 24, 1991

[30] Foreign Application Priority Data

Apr. 26, 1990 [JP] Japan ..... 2-111922
Apr. 26, 1990 [JP] Japan ..... 2-111924
Apr. 26, 1990 [JP] Japan ..... 2-111925

[51] Int. Cl.[5] ..... H04R 5/00

[52] U.S. Cl. ..... 381/18; 381/19; 381/22; 381/63

[58] Field of Search ..... 381/18, 19, 22, 63

[56] References Cited

U.S. PATENT DOCUMENTS 4,589,129 5/1986 Blackmer et al. ..... 381/18
5,046,098 9/1991 Mandell et al. ..... 381/22
5,068,813 11/1991 Thoen ..... 364/724.1
5,077,797 12/1991 Ishikawa ..... 381/18

FOREIGN PATENT DOCUMENTS 9000851 1/1990 PCT Int'l Appl. .

OTHER PUBLICATIONS

Electronics World & Wireless World, vol. 96, No. 1647, Jan. 1990 p. 35-37, 40-42, 44, Sutton, GB, P. Dolman: "Surrounded by Sound."

Patent Abstracts of Japan, vol. 13, No. 138 (p. 852) Apr. 6, 1989, & JP-A-63 304 468.

*Primary Examiner*—Jin F. Ng
*Assistant Examiner*—Edward Lefkowitz
*Attorney, Agent, or Firm*—Armstrong, Westerman, Hattori, McLeland & Naughton

[57] ABSTRACT

A method and an apparatus for processing audio signals with a directional emphasis by providing other channels besides the left and the right channels. An audio signal processing apparatus is divided into two blocks: a first block for processing digital signals of the left channel and the right channel supplied at each predetermined sampling period and outputting the signals of the left channel, right channel, and other channels which are amplified or decreased to a certain level; and a second block for detecting the level difference between the left channel signal and the right channel signal, and the level difference between the sum and the difference between the channel signals, and generating coefficients for adjusting the amplifying rate of the channels. The result is that the number of bits required for the signal processing can be reduced.

16 Claims, 10 Drawing Sheets

METHOD AND APPARATUS FOR PROCESSING AUDIO SIGNALS

FIELD OF THE INVENTION

This invention relates to a digital data non-linear transformation for providing output data which is non-linear with respect to input data, and more particularly to an audio signal processing apparatus using a digital data non-linear transformation method.

DESCRIPTION OF THE RELATED ART

A new stereo system capable of effectively reproducing the sound field in a cinema has been developed. Also, a home stereo apparatus in which the new stereo system is applied to the left and right channels of a conventional stereo system as a rear surround channel to realize stereo sound field reproduction in the home has been developed.

More recently, as development in the field advances a surround stereo system, providing a stereo sound field reproducing effect almost as good as that in the cinema, has been realized. This system features the processing of the original audio signals in the right and left channels by a method called directional emphasis for clarifying the normal position of the sound. In this reproduction method, left channel L, right channel R, surround channel S, and a center channel C are generated from the audio signals in the left and right channels. On generating these channels, the directional emphasis is added on the basis of the level difference between the left signal and the right signal.

FIG. 12 of the accompanying drawing is a circuit diagram showing a signal processing apparatus which performs directional emphasis.

The audio signal at each channel L, R is input to the respective band-pass-filter 1 to be removed of bands unnecessary for level detection. L−R (surround channel S) signal and L+R (center channel C) signal are generated in an adding and subtracting circuit 2 from the output of the band pass filters 1. An audio signal at each channel is rectified in the all-wave rectifying circuit 3 and then converted to voltages Lv, Rv, Sv, Cv representing the levels at each channel respectively. Further, these levels Lv, Rv, Sv, Cv are input to a logarithmic converting circuit 4 having differential inputs where the level differences of the channels, Lv−Rv, Cv−Sv are logarithmically converted. The logarithmically converted level differences Lv−Rv, Cv−Sv are integrated in the integrating circuit 5. The integrating circuit 5 has an integration time constant which is switched by a time constant switching circuit 6 on detecting the velocity of the change of the level differences Lv−Rv, Cv−Sv. From the integrated level differences Lv−Rv, Cv−Sv, the polarity judging circuit 7 generates four controlling signals EL, ER, Ec, ES. Namely, the polarity judging circuit 7 outputs: a voltage signal depending on the integrated value of LV−Rv to the EL where $R/L>1$; a voltage signal depending on the integrated value of Lv−Rv to ER when $R/L<2$; a voltage signal depending on the integrated value of Cv−Sv to the EC when $S/C>1$; and a voltage signal depending on the integrated value of Cv−Sv to the ES when $S/C<1$. A VCA (voltage controlled amplifier) 8 amplifies the audio signals of the left channel L and the right channel R by amplifiers controlled respectively by the controlling signals EL, ER, EC, ES, thereby outputting eight signals. An adding circuit 9 adds these eight signals to the audio signals of the left and right channels so as to provide and output channel signals of L, R, C, S respectively. These final signals are the directionally emphasized signals.

This technique, called "Dolby Pro Logic Surround System" proposed by Dolby Laboratories Liconsign Corp. of the United States, is described in more detail in Nikkei Electronics 1988 6, 27 (No. 450) at Page 88–89.

The audio signal processing apparatus for directional emphasis shown in FIG. 12 processes the input analog audio signals in analog mode.

However, a new DSP (digital signal processor) for audio signals which is capable of simply performing the processes of graphic equalization or reverberative sounds without deteriorating the sound quality has been recently developed. Namely, this DSP processes digital signals converted from analog audio signals for realizing various sound effects are applied, and thereafter the resulting digital output from the DSP is converted into an analog signal again. Here, the sampling frequency in A/D and D/A conversions is selected among 48 KHz, 44.1 KHz, or 32 KHz.

Then there has been proposed the provision of an audio signal processing apparatus having a directional emphasizing property using DSP as shown in FIG. 12. However, it has been difficult for the DSP, for example, to apply all the processes shown in FIG. 12 to the digital data being input at a sampling frequency of 44.1 KHz because of the enormously increased number of steps. Further, the requirement for a very high-speed operating DSP results in excessive production costs, thereby making it difficult to produce a popularly acceptable audio apparatus.

Moreover, in the DSP, the integrating circuit 5 and the time constant switching circuit 6 as shown in FIG. 12 are in general composed of digital low pass filters. However, it should be noted that the cut-off frequencies of the integrating circuit 5 and the time-constant switching circuit 6 are as low as 7 Hz and 0.34 Hz respectively. Therefore, if the sampling frequency is set as 44.1 KHz, the number of effective digits below the decimal point and the number of bits of data representing the multiple constant become so large that they can not even be represented with a DSP of 32 bits.

Furthermore, in order to establish the logarithmic converting circuit 4 in a DSP, a calculation based on an approximation such as Tayler's approximation or Chebyshev's approximation must be carried out therein. In such a case, the programming step and the required time for the calculation tends to be too long to make its realization in DSP possible.

On the contrary, there is another method of logarithmic conversion without using approximating calculations. This method is constituted, as shown in FIG. 13, by: uniformly dividing the input; storing the converted values corresponding to each divided input; and to compute the converted output data with the input data used as an address. However, according to this method, any different input values within a single divided region are output as the same output data, thereby the error from the respective true logarithmically converted value becomes too large. In addition, for minimizing the error, it has been necessary to increase the number of divisions for the input, causing increased amount of data. In consequence, a memory of enormous capacity becomes necessary, thereby lowering the utility efficiency of the memory.

SUMMARY OF THE INVENTION

It is therefore an object of this invention to provide an audio signal processing apparatus performing directional emphasis using a DSP, which is capable of reducing the number of steps processed during each sampling period at a low cost.

According to this invention, an audio signal processing apparatus performs directional emphasis by detecting the level ratio between a left channel signal and a right channel signal and the level ratio of the sum and difference levels of the channel signals, and by amplifying or reducing the levels of each output channel based on the detected result. The digital data of the left and right channel inputs are at each predetermined sampling period. A process of the digital data is divided into two blocks, one of which is completed at each sampling period, and the other is completed at an N times sampling period within the sampling period. The data process is performed at each of these blocks. In consequence, it becomes possible to reduce the number of bits of data representing the multiple constant of a digital filter having a low cut-off frequency, and the number of steps to be processed at each sampling period.

Namely, L+R (C) and L−R (S) are calculated from the left channel digital data L and the right channel digital data R input on each sampling period. By rectifying and integrating all the signal waves L, R, C, S at each sampling period, the output of this all-wave rectification and integration becomes less fluctuated during the sampling period. In consequence, the operation for obtaining eight coefficients based on the output of the all-wave commutation and integration can be carried out within N times the sampling period. The components which take part in this operation for obtaining eight coefficients are: a logarithmic converting means for logarithmically converting each of the outputs of the all-wave rectification and integration; a level difference calculating means for calculating the difference between the L and the R, and the difference between the L+R and the L−R, respectively from the output of the logarithmic converting means; a level detecting means for detecting when each output of the level difference calculating means reaches a predetermined level, by integrating the output by a first digital low pass filter; a second digital low pass filter which has a time constant switched in accordance with the output of the level detecting means, and receives the output of the level difference calculating means; a polarity judging means for discriminating its output on the basis of the output polarity of the second low pass filter; an inverse logarithmic converting means for inverse-logarithmically converting the output of the polarity judging means; and a coefficient generating means for generating a plurality of coefficients based on the output of the inverse logarithmic converting means. Thus, it becomes possible to decrease the number of bits of the multiple coefficient constututing the first and the second digital low pass filters. Further, since these operations can be dispersed to 1/N, the number of steps to be processed during each sampling period is reduced.

Further, according to the first method of this invention where the linear input data is converted into a non-linear output data, the following steps are implemented: plotting an approximate function curve representing non-linear output data versus input data, by lines formed by linking between the points corresponding to the input; pre-storing each "a" and "b" of a formula $y=ax+b$ representing each of the lines as output data corresponding to the input data; reading out the data "a" and "b" corresponding to the input data from the memory; and calculating the formula $y=ax+b$ and outputting converted data. Thus, in this method, the linear data can be converted into non-linear data with a reduced converting error, less data items, reduced memory capacity, and fewer program steps.

The output data corresponding to the input data do not vary in steps, but are output as gradient data and height data of an intercept. Consequently, a simple calculation of $y=ax+b$ can provide converted data. The difference between the function curve to be converted and the approximate broken line appears as an error. Compared to the error originating from the output data variating in steps, therefore, it becomes a significantly small error. Furthermore, the input width corresponding to the two points to be linked can be sufficiently widened, thereby reducing the number of divisions at the input side.

Moreover, if logarithnmic conversion and inverse logarithmic conversion are carried out by applying the aforementioned non-linear data conversion method to a signal processing apparatus for audio signals having directional emphasis, the utility efficiency of the memory incorporated in the DSP can be enhanced. The number of program steps can also be reduced. Thus, a signal processing apparatus for audio signals having digital directional emphasis can be easily realized.

In a second converting method where linear input data are converted into non-linear output data, the following steps are implemented: plotting an approximate function curve representing non-linear output data versus input data, from lines formed by linking between the points corresponding to the input $2^{n-1}$ (n=1,2, . . . N); pre-storing each "a" and "b" of a formula $y=ax+b$ representing each of the lines as output data corresponding to the input data; reading out the data "a" and "b" corresponding to the input data from the memory; and calculating the formula $y=ax+b$ and outputting converted data. Thus, in this method, the linear data can be converted into non-linear data with a reduced converting error, less data items, reduced memory capacity, and fewer program steps.

The output data corresponding to the input data do not vary in steps, but resembles thereto a broken line formed by linking the points representing the inputs $2^{n-1}$ (n=1,2, . . . N). Therefore, the sampling operation is performed in detail where the curvature is large, while it is performed roughly where the curvature is small. The gradient "a" of the linking lines and the height data "b" of the Y-axis intercept are transmitted as output data. Thus, the converted data can be easily obtained by the simple calculation $Y=aX+b$. In consequence, the difference of the function curve to be converted from the broken line semblance will appear as the error, which is quite smaller than that from the output varying in steps. In this manner, the maximum value between the function curve and the each broken lines would be equal. Furthermore, the sampling number will be equal to the number of data, thereby decreasing the number of data and the occupation rate of the data table in the memory can be reduced.

Further, if above-mentioned non-linear data converting method is applied to an audio signal processing apparatus for directional emphasis to perform logarithmic or inverse-logarithmic conversion, the availability of a memory built in a DSP increases and the number of program steps is reduced, thereby an audio signal processing apparatus for digital directional emphasis can be easily realized.

The above and other advantages, features and additional objects of this invention will be manifest to those versed in the art upon making reference to the following description and the accompanying drawings in which a structural embodiment incorporating the principles of this invention is shown by way of an illustrative example.

DETAILED DESCRIPTION

The principles of this invention are particularly useful when embodied in an audio signal processing apparatus such as shown in FIG. 1.

Figure 1A:
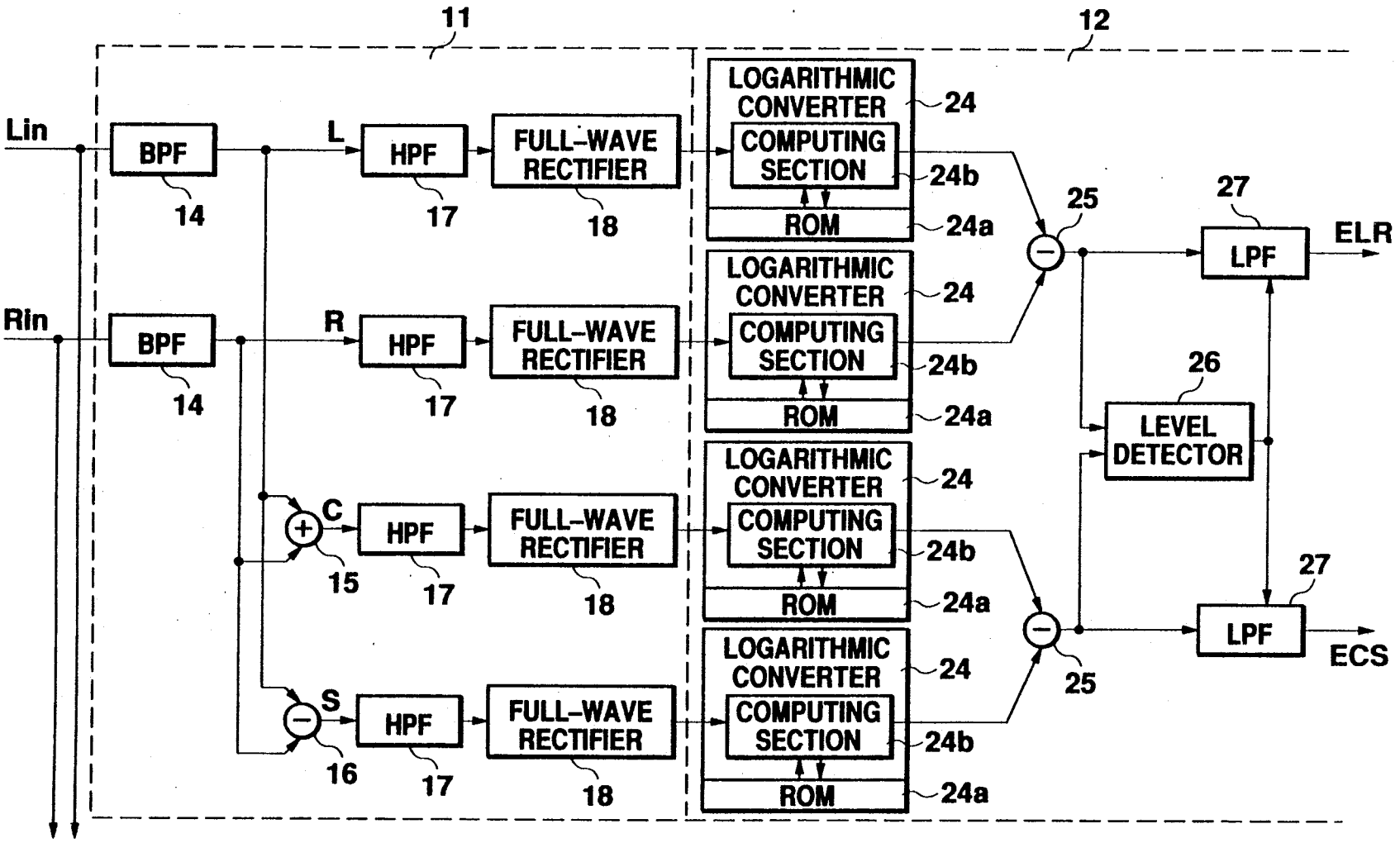
FIGS. 1(A) and 1(B) are block diagrams showing an embodiment of this invention.
Figure 1B:
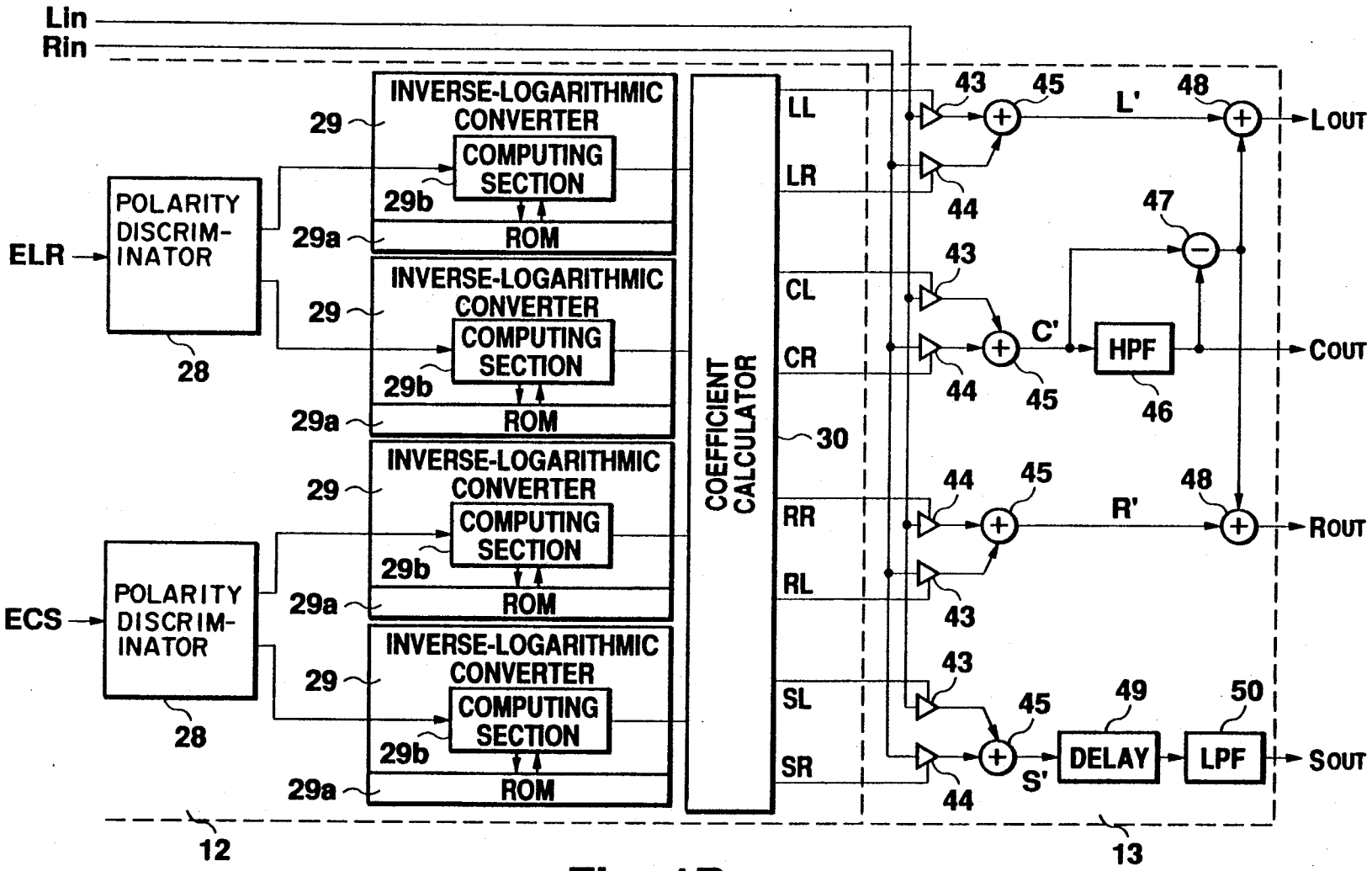

In FIGS. 1(A)-1(B), a first block 11 receives left channel digital data Lin and right channel digital data Rin at its inputs, and acts at each sampling period of 1/fs. A second block 12 receives and processes digital data output from the first block 11, and acts at a period increased by N times of the sampling period 1/fs. A third block 13 also acts at the sampling period 1/fs.

Each of the blocks will now be described in detail.

The first block 11 includes: digital band pass filter 14 to which left channel digital data LIN and right channel digital data RIN are input at each sampling period 1/fs (e.g. fs=44.1 KHz); an adder 15 for adding the outputs L and R of the digital band pass filter 14 to generate center channel data C; a subtractor 16 for calculating L−R from the outputs of the digital band pass filter 14 to generate surround channel data S; a digital high-pass-filter 17 to which the channel data L, R, C, S are input; a full-wave rectifier 18 for full-wave rectifying the output data of the digital high-pass-filter 17.

Figure 2:
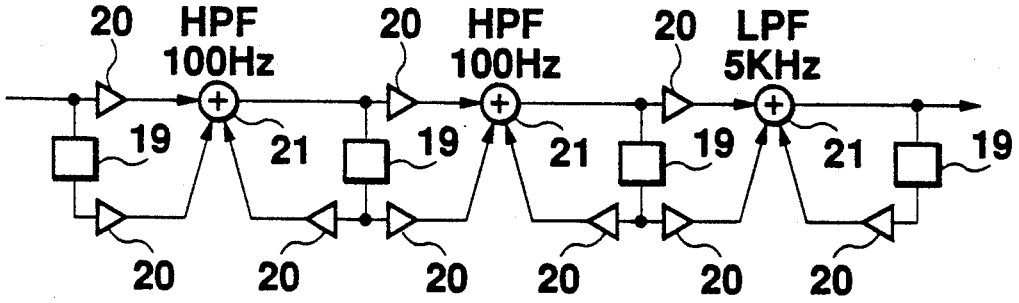
FIG. 2 is a circuit diagram showing the structure of the band pass filter in FIGS. 1(A)-1(B)

The digital band-pass-filter 14 is used to eliminate the frequency component unnecessary for detecting the levels of each channel, and consists of IIR (Infinite Impulse Response) digital filters of three stages being successively coupled. In FIG. 2, the numerals designate respectively: 19, a delay element for holding the data of one sampling period before; 20, a multiplier for multiplying the input data by a predetermined constant; 21, an adder. In this embodiment, the digital filters of the first and the second stages consist of high-pass-filters having a cut-off frequency of 100 Hz, while that of third stage consists of a low-pass-filter having a cut-off frequency of 5 KHz.

The high-pass filter 17 in the first block is identically composed to the digital filter of the first stage in FIG. 2, having a cut-off frequency of 218 Hz.

Figure 3:
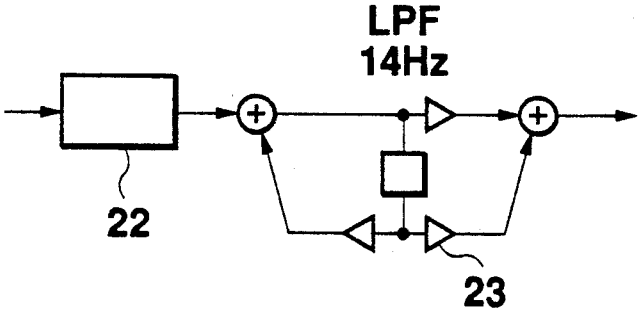
FIG. 3 is a circuit diagram showing the structure of the full-wave rectificator FIGS. 1(A)-1(B)

The full-wave rectifier 18 comprises an absolute value calculating circuit 22 and a low-pass-filter 23 as shown in FIG. 3. The absolute value calculating circuit 22 detects whether the most significant bit of the input digital data is "0" or "1", and outputs the input digital data as it is in case of "0", while it calculates and outputs the complement of the input digital data in case of "1". Thus, the circuit 22 fully rectifies the input digital data. The low-pass-filter 23 consists of a digital low-pass-filter having a cut-off frequency of 14 Hz and acts as an integrator in order to smooth the fully rectified output from the absolute value calculating circuit 22. The low-pass-filter 23 also functions as an anti-areas filter for eliminating the interference of the output signal frequency fs from the first block with the sampling frequency fs/N of the second block.

Moreover, the low-pass-filter 23 is composed as a type (referred as "2D type") different from the digital filter type in FIG. 2. Namely, its passing band is 14 Hz designed to prevent the degradation of the multiplication accuracy, by adding the product obtained by multiplying the delay data by the coefficient to the input data so as to prevent its number of effective digits from increasing. This is different from the digital filter in FIG. 2 where the product obtained by multiplying the input data by the constant is added to the product obtained by multiplying the delayed data by the constant.

Second block 12 operates at a period increased by N times of the sampling period 1/fs. That is, the output of the full-wave rectifier 18 at each sampling period of 1/fs is the integration result of the low-pass-filter 23. Therefore, the variation of the data appears gentle, thereby enabling the second block 12 to process the output therefrom at a lower sampling frequency. In this embodiment, this sampling frequency is selected as 2.75 Khz, being 1/16 of the output frequency of the full-wave rectifier 18 being taken account of.

The second block 12 comprises: a logarithmic converter 24 for receiving and logarithmically converting the digital data of the channels output from the first block at each 16 units; a subtractor 25 for calculating the level difference Le−Re and Ce−Se from the outputs Le, Re, Ce and Se of the logarithmic converters 24; a level detector 26 for receiving the level differences Le−Re and Ce−Se; a digital low-pass-filter 27 for receiving the level differences Le−Re and Ce−Se; a polarity discriminator 28 for receiving the outputs ELR and ECS from the digital low-pass-filter 27; an inverse logarithmic converter 29 for inverse-logarithmically converting the output of the polarity discriminator 28; and a coefficient calculator 30 for calculating eight coefficients based on the output from the inverse-logarithmic converter 29.

The logarithmic converter 24 to be used here contains a memory e.g. ROM storing a table of the input data and logarithmic output data. Instead, it would also be possible to perform approximate calculation based on the input data, i.e. to execute Chebyshev's approximation or Taylor's approximation to obtain the logarithmic output.

Figure 4:
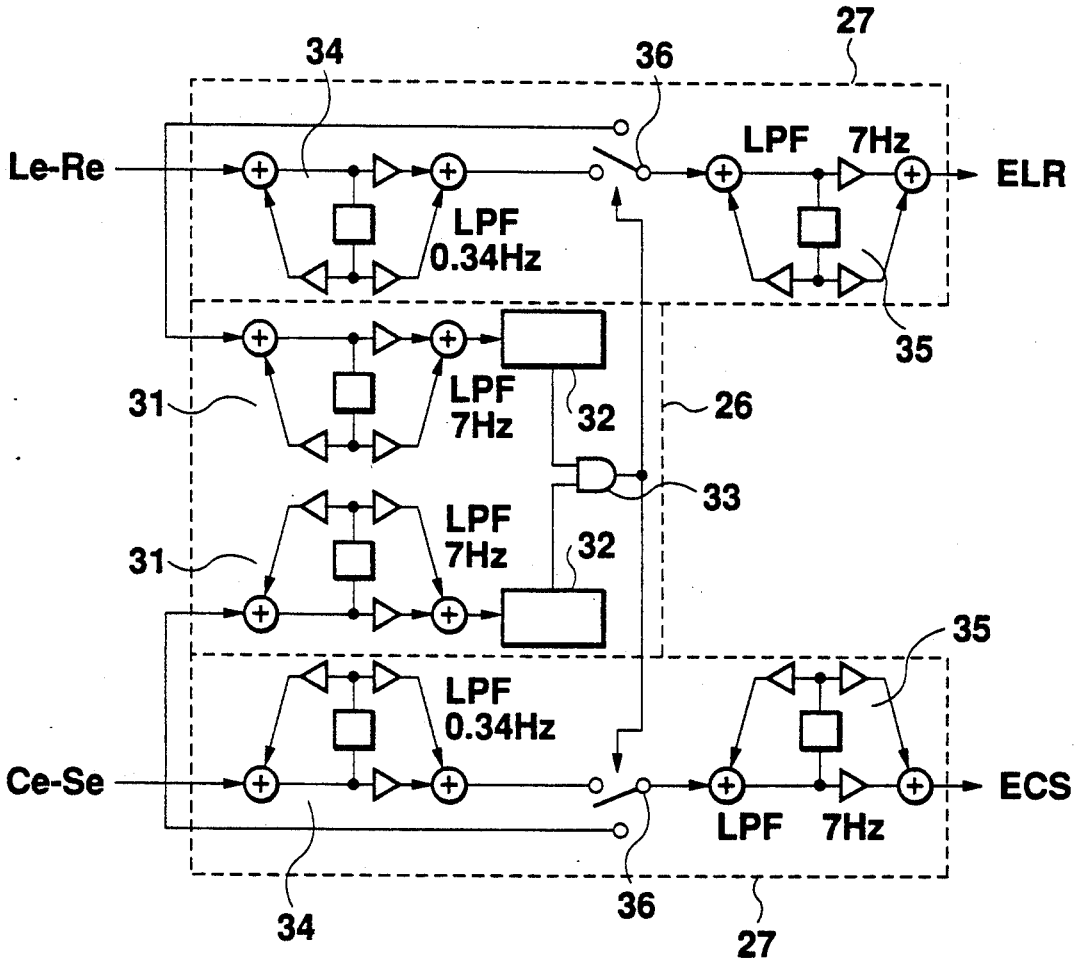
FIG. 4 is a circuit diagram showing the structure of the level detector and the digital low pass filter in FIGS. 1(A)-1(B)

The level detector 26 and the low-pass-filter 27 are composed as shown in FIG. 4. The level detector 26 comprises: a digital low-pass-filter 31 having a cut-off frequency of 7 Hz; level sensors 32 for the sensing the output data having become lower than a predetermined value; and an AND gate 33 for detecting the outputs of both the level sensors 32. Meanwhile, each of the digital low-pass-filters 27 consists of a digital low-pass-filter 34 having a cut-off frequency of 0 Hz and a digital low-pass-filter 35 having a cut-off frequency of 7 Hz. The input to the digital low-pass-filter 35 is switched by a switch 36 controlled by the output of the AND gate 33. When both the level difference data Le−Re and Ce−Se are so small that both corresponding level sensors output indication that low level criterion have been met, the output of the digital low-pass-filters 34 are input to the digital low-pass-filters 35. Otherwise, the level difference data Le−Re and Ce−Se are input directly to the digital low-pass-filters 35.

The digital low-pass-filters 31, 34, and 35 in the second block 12 have a very low-passing band so are designed in 2D-type as a digital low-pass-filter 23, for preventing the degradation of the multiplication accuracy. Since the sampling frequency in the second block 12 is set as low 2.75 Khz, the bit length of the filter coefficient of these digital low-pass-filters 31, 34, and 35 are retained to approximately 16 bits or so.

Figure 5:
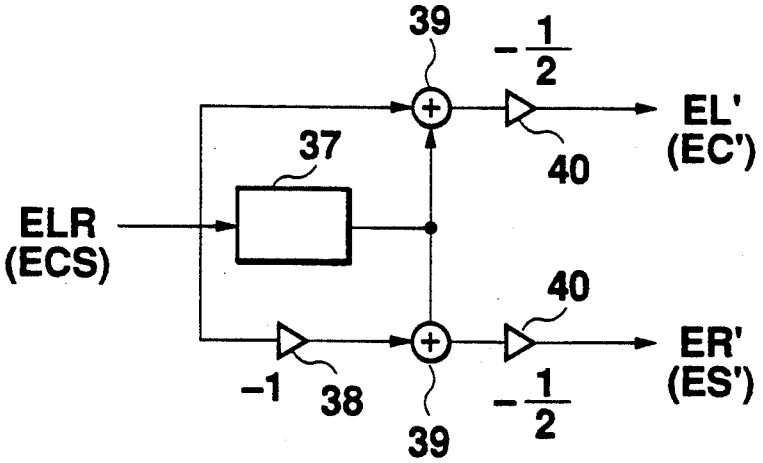
FIG. 5 is a circuit diagram showing the structure of the polarity judging means in FIGS. 1(A)-1(B)

The polarity discriminator 28 discriminates the polarity of the outputs ELR and ECS, namely determining whether each of the outputs ELR and ECS is positive or negative. As shown in FIG. 5, the polarity discriminator 28 includes an absolute value calculator 37, a−1 multiplier 38, and adder 39, a−½ 40. For instance, if ELR is positive, the output of the absolute value calculator 37 is ELR, and one output of the adder 39 becomes 2ELR while the other is zero. Accordingly, the multiplier 40 outputs−ELR from its one output terminal EL′, while the other output terminal EL′ outputs zero. On the contrary, if ELR is negative, the multiplier 40 outputs−ELR from its output terminal ER′, while the other output terminal EL′ outputs zero. The same is true in ECS.

The inverse-logarithmic converter 29 incorporates a table such as ROM storing the logarithmic inputs and the output data therein as in the logarithmic converter 24. This converter 29 inverse-logarithmically converts the outputs EL′, ER′, EC′, and ES′ from the polarity discriminator 28 in order to generate data EL, ER, EC, ES for carrying out the directional emphasis process.

Figure 6:
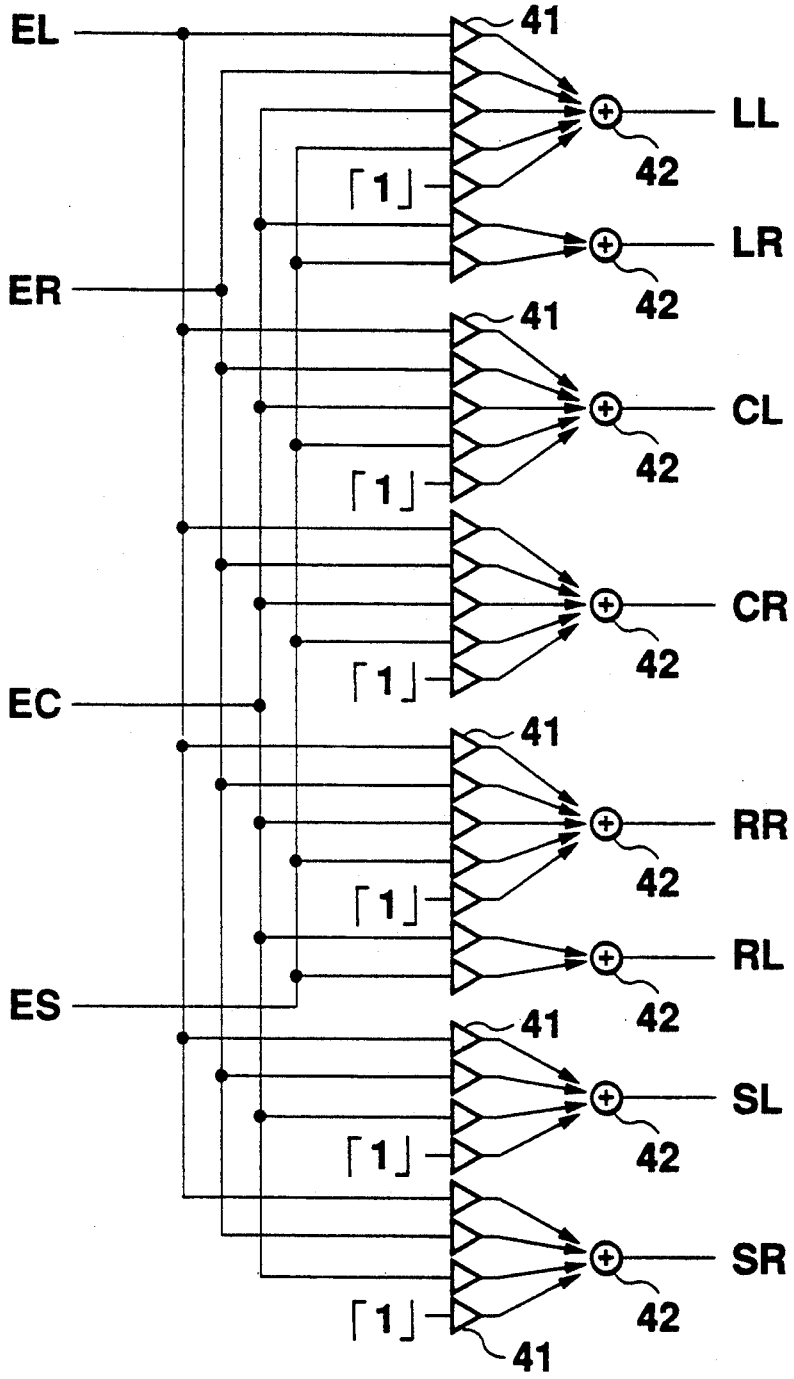
FIG. 6 is a circuit diagram showing the structure of the coefficiency calculator in FIGS. 1(A)-1(B)

The coefficient calculator 30 generates eight coefficients, by which the left channel digital data Lin and right channel digital data Rin are multiplied, composed as shown in FIG. 6. The constants LL, CL, CR, RR are obtained by multiplying the data EL, ER, EC, and ES by a respectively predetermined constant in the multiplier 41 and adding the multiplied product to a predetermined constant in the adder 42. The constant LR, RL are obtained by multiplying the data EC, ES by a respectively predetermined constant in the multiplier 41 and adding the multiplied product to a predetermined constant in the adder 42. The constants SL, SR are obtained by multiplying the data EL, ER, EC by a respectively predetermined constant in the multiplier 41 and adding the multiplied product to a predetermined constant in the adder 42.

The third block 13 operates at the same sampling period 1/fs as the first block 11, and includes: a multiplier 43 for multiplying the left channel digital data Lin input at each sampling period by respectively the coefficient values LL, CL, RL, and SL output from the second block; a multiplier 44 for multiplying the right channel digital data RIN respectively by the coefficient values LR, CR, RR, SR; an adder 45 for adding the output of the multiplier 43 to the output of the multiplier 44 to generate digital data L′, R′, C′, and S′ for each channel; a digital high-pass-filter 46 for eliminating the low frequency component of the input channel data C′ so as to output center channel data Cout; a subtractor 47 for subtracting the output data of the digital high-pass-filter 46 from the channel data C′ to obtain the low band portion of the center channel; an adder 48 for adding the obtained low band portion to the channel data L′ and R′ to output left channel digital data Lout and the right channel digital data Rout; a delay element 49 for delaying the channel data S′; and a low-pass-filter 50 for eliminating the high band portion of the data supplied from the delay element 49 to output the surround channel digital data Sout. The digital high-pass-filter 46 has a cut-off frequency of 100 Hz, while the digital low-pass-filter 50 has a cut-off frequency of 7 KHz.

The third block 13 receives the coefficient values LL, CL, RL, SL and LR, CR, RR, SR each at 16 times its own operation rate, and continues to use the same data for processing until receiving next new data. The outputs Lout, Rout Cout, and Sout processed in the third block 13 become direction-emphasized output, which are then subject to D/A conversion and reproduction, thereby realizing the reproduction of an effective stereo acoustic field.

Thus, the coefficient accuracy of the digital low-pass-filters 31, 34, and 35 can be ensured by operating the first and the second blocks with a sampling frequency fs=44.1 KHz while the second block with 2.75 KHz being 1/16 thereof.

Namely, the three multiplying coefficient a, b, and c of the low frequency digital filters can be expressed as follows:

$$a=\omega_0/(\omega_0+2fs)$$

$$b=\omega_0/(\omega_0+2fs)$$

$$c=(\omega_0-2fs)/(\omega_0+2fs)$$

$$\omega_0=2fs\tan(\pi fc/fs)$$

where fs=sampling frequency, fc=cut-off frequency.

Accordingly, in a very low band low-pass-filter, the higher the sampling frequency, the closer the $\omega_0$ is to zero, because the fc/fs approximates to zero.

As a result, it becomes a=0, b=0, c=−1, resulting in an enlarged of effective digital number of the coefficient. To cope with this problem, lowering the sampling frequency fs would increase the value of fc/fs, thereby enabling a decrease in the effective digital number of the coefficients a, b, and c to enhance the coefficient accuracy.

Figure 7:
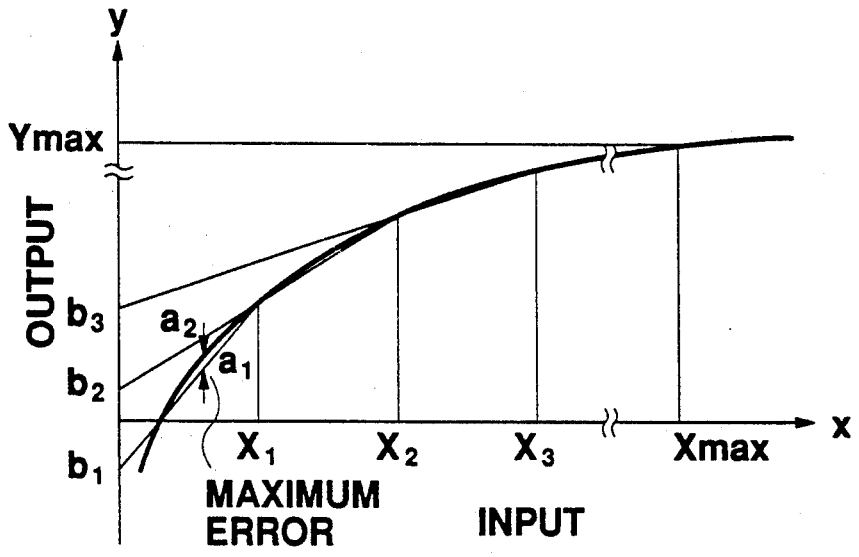
FIG. 7 is a graphic diagram showing the first converting method of the logarithmic converter in FIGS. 1(A)-1(B)

FIG. 7 is a graphic diagram showing a first example for the function conversion according to this embodiment, in the case of logarithmically converting the input data. A logarithmic curve, with X-axis for input and Y-axis for converted data, is plotted. From the origin of the X-axis, X1, X2, X3, . . . are established with a predetermined interval. For example, when the input data has 16 bits, X1, X2, X3, . . . are established with an interval represented by the upper four bits of the data.

The output data corresponding to the input data from 0 to X1 would have the value of gradient a1 of a linear formed by linking the intersection of X-axis and the curve with a point of the curve corresponding to X1 and the corresponding Y-axis intercept b1. Also, the output data corresponding to the input data from X1 to X2 would have the value of gradient a2 of a linear formed by linking the two points on the curve corresponding to X1 and X2 and the corresponding Y-axis intercept b2. In the same manner, each output data has a gradient ai and Y-axis intercept bi corresponding to its input data Xi. The Y-axis output data is determined such that the maximum value Xmax of the input data and the maximum value Ymax of the output data represented by a number of bits become mutually identical.

Also for the input data below the intercept of X-axis and the curve, the calculation based on ai and bi would be applicable in case of DSP for processing audio signals. The obtained data of the gradient and Y-axis intercept in FIG. 7 are stored in a memory using corresponding inputs 0, X1, X2, X3, . . . as addresses. For logarithmically converting the input data, the gradient and the Y-axis intercept are read out by designating the address with the upper several bits of the input data i.e. the number of upper order bits (in above-mentioned case, four bits) used in dividing the X-axis at regular intervals. For instance, in case of an input data between X2 and X3, the gradient a3 and the Y-axis intercept b3 are obtained with an address of X2. By executing Y=a3 Xin+b3, the converted data Y can be obtained.

Figure 8:
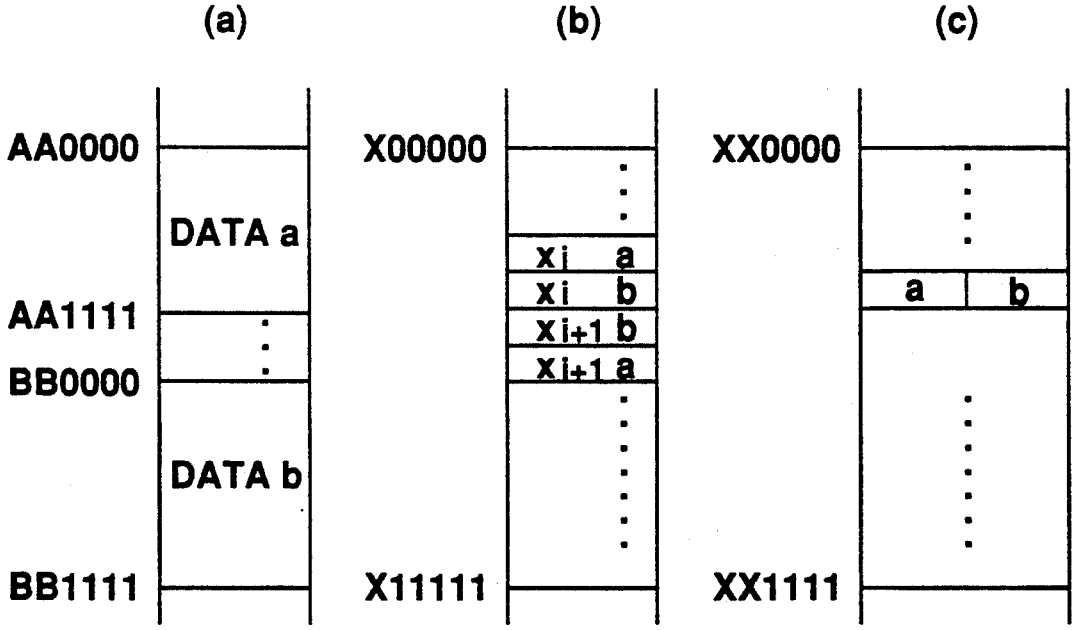
FIG. 8 is an address map of the function converting method in FIG. 7.

FIG. 8 shows an address map showing a pattern for storing the gradient data a and the Y-axis intercept b when the X-axis is divided into 16 pieces. FIG. 8(*a*) shows a case where the gradient data a and the Y-axis intercept data b are stored in individual address area. The gradient data a is stored in addresses from "AA0000" to "AA1111", while the Y-axis intercept data b is stored in addresses from "BB0000" to "BB1111". In this case, the gradient data a and the Y-axis intercept data b is accesseb by its upper bits AA and BB, respectively with the upper four bits of the input data using as lower four bits of the address data.

FIG. 8(*b*) shows a case where the gradient data a and the Y-axis intercept data b are alternately stored at addresses from "x00000" to "x11111". In this case, a least significant bit is added to the upper four bits of the input data, and the gradient data a and the Y-axis intercept b are obtained when the least significant bit is set to "0" and "1", respectively.

FIG. 8(*c*) shows a case where the gradient data a and the Y-axis intercept data b are stored in a single address. In this case, the gradient data a and the Y-axis intercept data are obtained by using the upper four bits of the input data as the lower four bits of the address data.

These data are stored in a ROM 24*a* and 29*a* in FIG. 1. In the logarithmic converter 24, the data a and b in the ROM 24*a* are read out by the calculating section 24*b* and subject to aforementioned calculations to logarithmically convert the input data X into the output data Y. Meanwhile, in the inverse-logarithmic converter 29, the calculating section 29*b* executes a calculation inverse thereto to inverse-logarithmically convert the data.

The logarithmic converter 24 carries out the logarithmic conversion in such a manner as shown in FIG. 7, and uses a ROM which stores the gradient data a and the Y-axis intercept data b therein by the data storing method shown in FIG. 8(*c*).

The inverse-logarithmic converter 29 inverse-logarithmically converts the data by the same method as in the logarithmic converter 24, and exhibits an inverse-logarithmic curve with respect to the input data in contrast to the logarithmic curve in FIG. 7. This converter 29 uses a ROM containing the gradient data a and the intercept data b with respect to the input data for inverse-logarithmically converting the outputs EL', ER', EC', and ES' from the polarity discriminator 28 so as to generate the data EL, ER, EC, and ES for executing the directional emphasis process.

Figure 9:
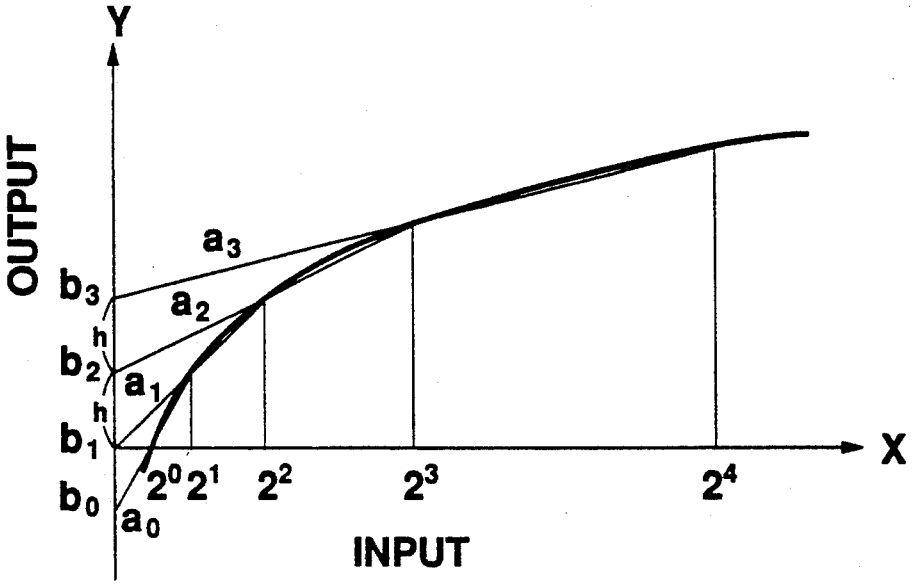
FIG. 9 is a graphic diagram showing the second converting method of the logarithmic converter in FIGS. 1(A)-1(B)

FIG. 9 shows a graphic diagram of an example of a second function convertion for logarithmically converting the input data. A logarithmic curve, with the X-axis for the input and the Y-axis for the converted data, is disclosed. The X-axis is sampled with a relationship of $2^0, 2^1, 2^2, 2^3, \ldots 2^n$, ($n=N-1$, N: number of bits of the input data) from the intersection of the logarithmic curve and the X-axis as the origin. The points on the curve, corresponding to each of the sampled input data, are mutually linked to approximate to the logarithmic curve. The values of the gradient a1 and the Y-axis intercept b1 of the line formed by linking two points on the curve corresponding to $2^0-2^1$ are taken as output data of the input $2^0$. The gradient a2 and the Y-axis intercept b2 of the line formed by linking two points on the curve corresponding to $2^1-2^2$ are taken as output data of the input $2^1$. In the same manner, the gradient an and the Y-axis intercept bn for the respective input $2^n$ are taken as output data. The output data for the Y-axis is determined such that the maximum value 2N of the input data equals the maximum value Ymax represented by the number of bits of the output data when the input data has N bits.

In FIG. 9, the relationship between each gradient and the Y-axis intercept bn is $a_0=2a_1=4a_2= \ldots =2^n a_n$. Further, since there is a relationship of $b_n-b_{n-1}= \ldots =b_1-b_0=h$ (constant), the respective gradient and the Y-axis intercept can be easily calculated by storing $a_0$ and h.

The gradient data and the Y-axis intercept data obtained in the embodiment of FIG. 9 are stored in a memory with $N-n-1$ with respect to the input data as its address. For instance, in case of N=16 bits, the gradient data $a_0$ and the Y-axis intercept data $b_0$ corresponding to $2^0$ are stored in the memory region of address 15, the gradient data $a_1$ and the Y-axis intercept data $b_1$ corresponding to $2^1$ are stored in the memory region of address 14, and the gradient data $a_{15}$ and the Y-axis intercept data $b_{15}$ corresponding to $2^{15}$ are stored in the memory region of address 0. Thus stored gradient data a and the Y-axis intercept data are taken out according to the flow chart of FIG. 11. Firstly it is examined at which bit order from the most significant bit of the input data is "1". If the most significant bit of the input data is "0", the counting number of the counter is increased by 1, and the input data are shifted by one bit in the direction of upper bits. Then it is again determined if the most significant bit is "1". If it is "1", this means that the input data is $2^{14}+2^i$ (i is less than 14) and the subjected data are the gradient data $a^{14}$ and the Y-axis intercept $b^{14}$ corresponding to $2^{14}$. Therefore, the address 1 will be accessed. In other words, the counting number in the counter may be used as the address data.

These data are stored in ROM 24*a* and ROM 29*a* in FIGS. 1(A)-1(B). In the logarithmic converter 24, the data a and b in the ROM 24*a* is read out by the calculating section 24*b* to be served to the above-mentioned calculation for the logarithmic conversion of the input data X into the output data Y. On the contrary, in the inverse-logarithmic converter 29, a similar calculation performed inversely.

In the shown embodiment, the logarithmic converter 24 executes the logarithmic conversion according to the method described referring to FIG. 9, using a ROM for storing the gradient data a and the Y-axis intercept data b therein.

The inverse-logarithmic converter 29 executes the inverse-logarithmic conversion according to the same method as the logarithmic conversion according to the same method as the logarithmic converter 24, but it exhibits a inverse-logarithmic curve in contrast to the logarithmic curve appearing in FIG. 9, and uses a ROM storing the gradient data a and the Y-axis intercept data b therein. It inversely converts the outputs EL', ER', EC', and ES' to generate data EL, ER, EC, and ES for directional emphasis.

Figure 10:
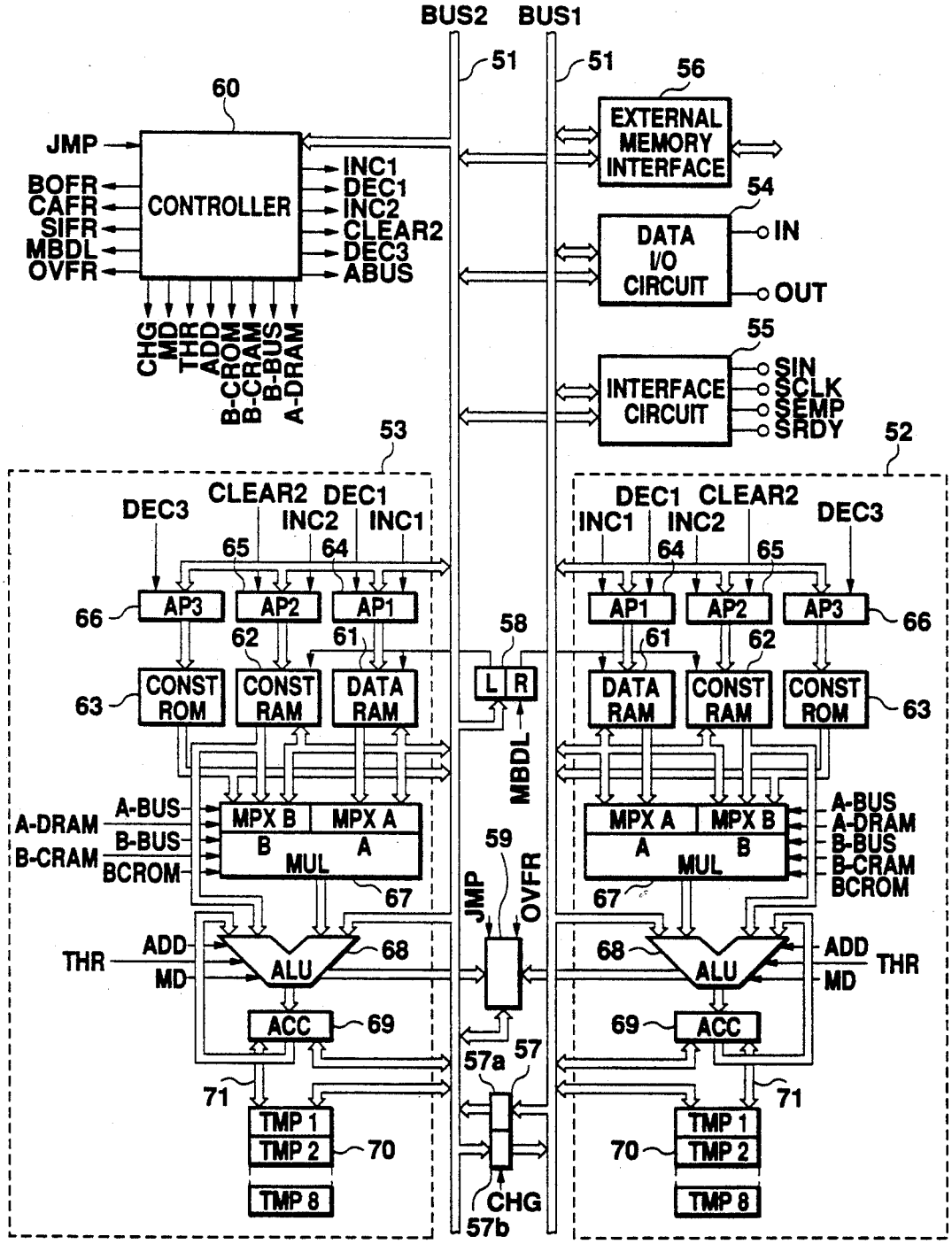
FIG. 10 is a block diagram showing a DSP suitable for embodying the audio signal processing apparatus in FIGS. 1(A)-1(B)
Figure 12:
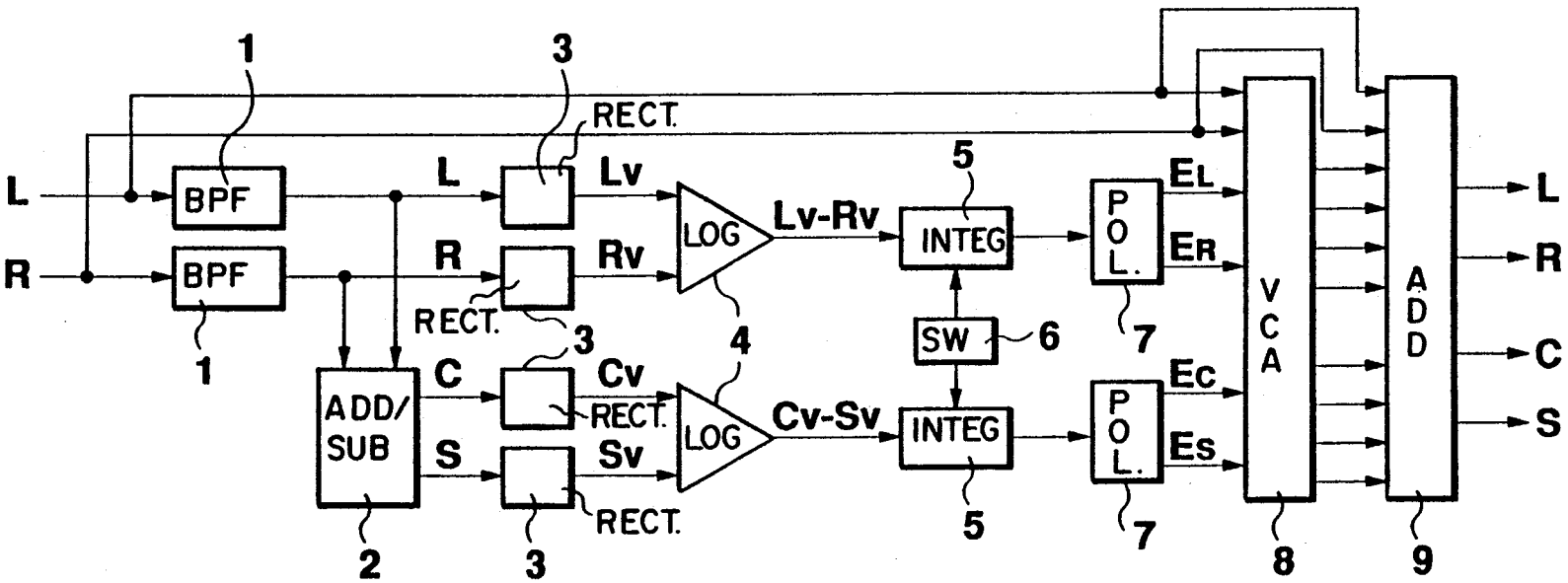
Fig. 12 (PRIOR ART)
FIG. 12 is a block diagram showing a conventional audio signal processing apparatus.
Figure 13:
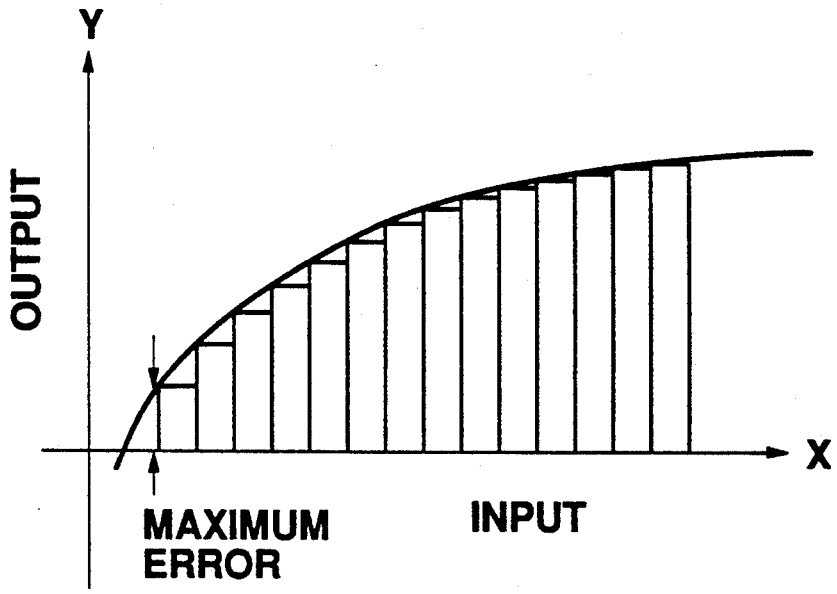
Fig. 13 (PRIOR ART)
FIG. 13 is a graphic diagram showing a conventional function converting method using a data table.

Next, FIG. 10 shows the optimum DSP for realizing the audio signal processing apparatus for directional emphasis in FIGS. 1(A)-1(B). This DSP system is integrated on a one-chip semiconductor element for audio signal processing, and comprises: a pair of data bus 51; digital processors 52, 53 connected to the data bus 51 respectively; a data input/output circuit 54 connected to the data bus 51; an interface circuit 55; a data exchange register 57; a memory controlling register 58; a condition branch controlling circuit 59; and a controlling circuit 60 for controlling the operation of the aforementioned components.

The bus 51 is composed of 24 bits (each 8 bits×3). The data input/output circuit 54: receives the left and right channels sampling data of 16 bits serially input to its input terminal IN; transmits the right channel data and the left channel data to the data bus BUS 1 and BUS 2 respectively; and receives the processed data through the data bus BUS 1 and BUS 2 and serially output these through the output terminal OUT.

The data processing circuit 52 is for processing the right channel data, while the data processing circuit 53 is for processing the left channel data, both with identical composition. Namely, these data processing circuits 52, 53 include: a data RAM 61; a constant RAM 62; a constant ROM 63; an address pointer 64, 65, 66; a multiplier (MUL) 67; an 64 an accumulator (ACC) 69; and temporary registers (TMP 1—TMP 8) 70. The data RAM 61, connected to the data bus 51 and the input of the multiplier 67, has a capacity of 24 bits×128 for storing the data processed and before processed which are supplied from the data input/output circuit 54. The constant RAM 62 has a capacity of 16 bits×256 for storing e.g. the constant of the digital filter supplied from the interface circuit 55, and connected to the data bus 51, the input of the multiplier 67, and the input of the ALU 68. The constant ROM 63 has a capacity of 24 bits×256 for fixingly storing e.g. the fixed multiplication constant for the digital filter and the data table for logarithmic and inverse-logarithmic conversion, and connected to the data bus 51 and to the input of the multiplier 67.

The address pointer 64 is composed of 8 bits for designating the addresses of the data RAM 61, and controlled by the micro code INC1 and DEC21. Further, the address pointer 65 has a capacity of 10 bits for designating the addresses of the constant RAM 62, and controlled by the micro code INC2 output from the controller 60. The address pointer 66 has a capacity of 8 bits for designating the addresses of the constant ROM 63, and controlled by the micro code DEC output from the controller 60.

The multiplier 67 executes the multiplication of 24 bits×16 bits. Its input A corresponds to 24 bits, and input B to 16 bits. The multiplied product is determined one cycle thereafter. An input selector circuit MPXA and MPXB are provided at the input A and the input B of the multiplier 67. The input selector circuit MPXA selects the data bus 51 by the micro code A-BUS and selects the RAM 61 by the micro code A-DRAM output from the controller 60, and supplies them to the input A. The input selector circuit MPXB selects the data bus 51 by the micro code B-BUS, and selects the constant RAM 62 by the micro code B-CRAM, and selects the constant ROM 63 by the micro code B-CROM, and supplies them to the input B. The multiplied product will be output at 32 bits.

The ALU 68 is a calculator having a capacity of 32 bits and adds the 32 bits-products supplied to its one input to the 32 bits-data of the ACC 69 supplied to the other input by the microcode ADD, and the result is transferred to the ACC 69. Among the 32 bit- of ACC 69, the upper 24 bits are coupled to the data bus 51 and the lower 8 bits are coupled to the lower 8 bits of the temporary register 70 through the sub-bus 71. The temporary register 70 is composed of 32 bits-registers TMP 1, TMP 2, . . . TMP 8, and storing the 32 bits-data up to eight units, and its upper 24 bits are connected to the data bus 51. Through the data bus 51 and the sub-bus 71, the 32 bit-data are transferred between the temporary register 70 and the ACC 69.

The controller 60 controls the component circuits in accordance with the previously programmed sequence, and is also able to control each of the components circuits of the data processor 52, 53, simultaneously altogether or individually. The controller 60 contains program ROM (or RAM) therein, and outputs the following signals by executing the programs read out from the program ROM: INC 1, INC 2, DEC 1, CLEAR 3, DEC 3 for controlling the address pointers 64, 65, 66; A-BUS, A-DRAM<, B-BUS, B-CRAM, B-CROM for controlling the input selector circuits MPXA, MPXB; ADD, THR, MD for controlling ALU 68; CHG for controlling data exchange register 57; OVER, SIFR, CAFR, BOFR for controlling the condition ramification controlling circuit 59; MDDC for controlling the memory controlling register 58.

The interface circuit 55 carries out data transmission/reception between the DSP system and an external controller e.g. microcomputer (not shown).

The external memory interface circuit 56 performs address designation and data transmission/reception to/from a memory externally connected to the DSP system.

The data exchange register 57 comprises a 24-bits R-L register 57*a* for holding the data transmitted to the data BUS 1 and outputting them to the data BUS 2, and a 24-bits L-R register 57*b* for holding the data transmitted to the data BUS 2 and outputs them to the data BUS 1. Upon the execution of the exchange instruction, the data holding and outputting are carried out simultaneously during one instruction cycle by the controlling signal CHG supplied from the controller 60 in both the R-L register 57*a* and the L-R register 57*b*. Accordingly, it is possible to mutually exchange the right channel digital data and the left channel digital data, to multiply the data of the counter channel by a predetermined coefficient respectively and to add subtract them to/-from their own digital data.

The condition branch controlling circuit 59 selects the signal output when the digitally processed output from the ALU 68 in the digital processor 52, 53 come to a predetermined state, based on the data applied from the data BUS 2, and generates a jump controlling signal JMP.

If the DSP shown in FIG. 10 is applied for embodying the signal processing apparatus shown in FIGS. 1(A)–1(B), each of the digital processor 52, 53 can be in charge of the respective process at the same time. Namely, the digital band-pass-filter 14 for filtering the left channel digital data and the right channel digital data is independently constituted at each of the digital processors 52, 53 respectively. Their output results are transmitted to each of the digital processors 52, 53 through the data exchange register 57 of DSP. Thereafter, the processes for the left and right channels are basically executed in the digital processor 52, while the processes for the center channel and the surround channel in the digital processor 53.

Also, on composing the various digital filters shown in FIGS. 2–5 at each of the digital processor 52, 53, the multiplication of the coefficient is executed in the multiplier 67, while the addition and the subtraction are executed in the multiplie ALU 68. Namely: the digital data to be supplied to the filter is applied to the input A of the multiplier; multiplying the input B by a filter coefficient read out from the constant ROM; and further multiplying the data of the sampling period before from the data RAM 61 by the filter constant from the constant ROM 63. The multiplied products output from the multiplier 67 are served to the addition process in the ALU 68 and ACC 69 repeatedly, thereby realizing efficient filtering.

Further, the absolute value calculating circuit 22 of the full-wave rectifier 18 and the absolute value calculating circuit 37 of the polarity discriminator 28 detects the most significant bit in the ALU 68, and calculates the compliment data depending on the resulted bit. The level detector 32 and the AND gate 33 compare the output of the multiplier 67 being the output of the digital low-pass-filter 31 to a predetermined value in the ALU 68. The condition branch controlling circuit 59, depending on the compared result, generates JMP controlling signal for allowing the process digital low-pass-filter 34 by the program at the jumped position. The logarithmic converter 24 and the inverse-logarithmic converter 29 order the constant ROM 63 of one digital processor to store the logarithmic conversion table, the constant ROM 63 of the other digital processor to store the inverse-logarithmic conversion table, thereby mutually accessing to the other's constant ROM 68. Alternatively, it is also possible to store the logarithmic conversion table and the inverse logarithmic conversion table in the program ROM of the controller 60 which is then accessed.

In order to operate the first block 11 and the third block 13 in FIGS. 1(A)–1(B) at the sampling frequency fs=44.1 KHz, on each time of receiving the left and right channels digital data Lin and Rin, the program for performing the processes of the first block 11 and the third block 13 are completed by when the next data are supplied. Meanwhile, in order to operate the second block 12 at a frequency of 1/16 of the sampling frequency fs, the program for the process of the second block 12 is divided uniformly into 16 pieces, each of which is executed at each sampling period before or after executing the programs for the first and third blocks. At this time, the processed result must be retracted to the data RAM 61 for the use in the next sampling period.

Thus, according to the DSP shown in FIG. 10, a single program can control both of the data processors 52, 53, the number of program steps can be reduced, thereby enabling to realize easily the audio signal processing apparatus for directional emphasis shown in FIG. 1.

As mentioned above, according to this invention, the audio signal processing apparatus comprises two different blocks, one operating at a sampling cycle of the A/D-converted audio signal, and the other operating at a period increased by N times of the sampling period. In consequence, the number of bits of digital filter coefficient can be reduced so as to enable the calculation with high accuracy. Further, the process for the block operating at the period increased by N times of the sampling period is uniformly divided into 1/N, thereby decreasing the number of steps to be processed during one sampling period to enhance the throughput.

Next, the first converting method shown in FIG. 7 will be described specifically. When the data X1 to be converted is generated, the upper 4 bits are set in the address pointer 66, and the gradient data a and the Y-axis intercept data b stored in the same address are read out from the constant ROM 63. The readout data are then supplied to the ALU 68 which shifts down the data to left only the gradient data a of the upper bits. This left gradient data a is supplied to the input B of the multiplier 67 through the ACC 69 while the data X1 held in the data RAM 61 is supplied to the input A, and then the multiplying calculation starts. During the multiplier 67 is executing the multiplication, the gradient data a and the Y-axis intercept data b are read out from the constant ROM 63 by the data set in the address pointer 66 to be supplied to the ALU 68. The gradient data a of the upper bits is masked by the masking function of the ALU 68 so that only the Y-axis intercept data b of the lower bits is kept in the ACC 69. Then the multiplied products from the multiplier 67, namely, the a X1 and the Y-axis intercept data b held in the ACC 69 are added in the ALU 68 to provide the converted data $Y=aX1+b$.

Thus, by storing the gradient data a and the Y-axis intercept data b in the constant ROM 63, the calculation $Y=aX1+b$ can be executed in significantly shortened step. Further, since the amount of data required for the conversion is small, only a part of the constant ROM 63 is used, without sacrifying the other data of filter coefficient etc. to be stored.

Thus, according to this invention, the amount of data, to be stored in the memory used as a table for the data conversion, can be reduced and the calculation based on the data read out from the memory can be simplified. Consequently, high-speed data conversion with reduced number of program steps is realized. Further, the conversion error can be minimized, thereby providing digital processing with high accuracy.

In addition, since the processing load applied on the DSP can be lightened significantly, the audio signal processing apparatus for directional emphasis, conventionally performed by analogue process, can be performed easily with high accuracy by digital process.

Figure 11:
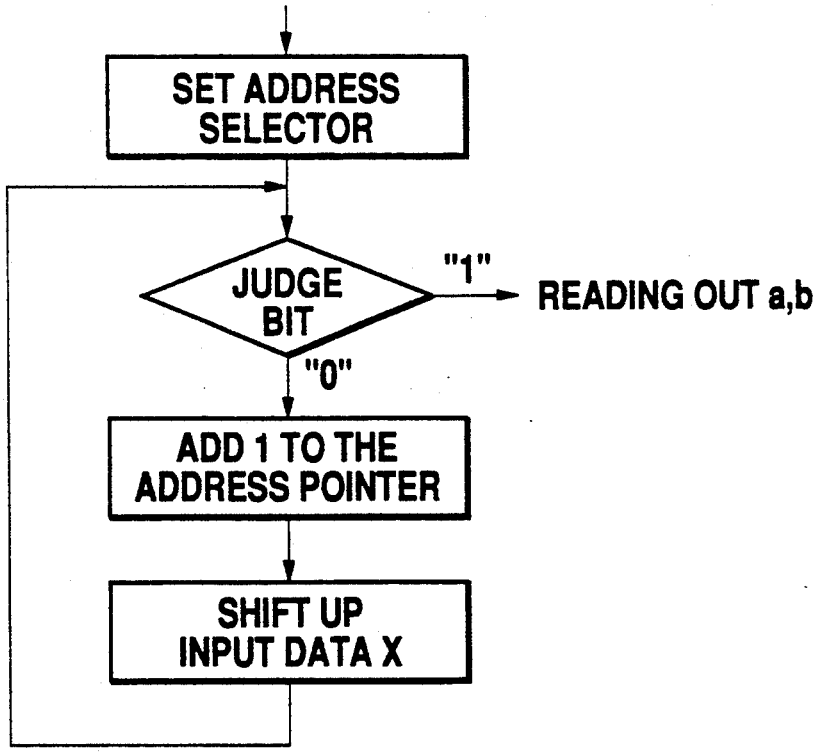
FIG. 11 is a flow chart showing a data converting operation of the second logarithmic converting method.

Next, the second converting method shown in FIG. 9 will be specifically described referring to the flow diagram of FIG. 11. When the data X1 to be converted is generated, the address data storing the gradient and the Y-axis intercept corresponding to the input data 2 are set in the address pointer 66. The data Xi is input to the ALU 68 to be determined if its most significant bit is "1". If the result is affirmative i.e. being "1", the address pointer 66 reads out the gradient data a15 and the Y-axis intercept data b15 stored at the address from the constant ROM 63. If the result is negative i.e. "0", the address pointer 66 is incremented and the data Xi in the ALU 68 is shifted in the upper bit direction by one bit, and then the determination of the most significant bit is carried out again. In this manner, the same operation is repeated until the most significant bit is determined as being "1". Thus, address pointer 66 becomes address data for storing the data corresponding to the input data. The data read out from the address pointer 66 is input to the ALU 68, which shifts down the data to left only the gradient data a of the upper bits. This leave left gradient a and the data X1 held in the data RAM 61 are supplied respectively to the input A and the input B of the multiplier 67. The multiplier 67 then starts the multiplication. Meanwhile, the gradient data a and the Y-axis intercept data b are read out by the data set in the address pointer from the constant ROM 63 to be input to the ALU 68. The gradient data a of the upper bits is masked by the masking function of the ALU 68 to keep only the Y-axis intercept data b of the lower bits in the ACC 69. The multiplied product supplied from the multiplier 67 i.e. the aX1 and the Y-axis intercept data b held in the ACC 69 are added to each other in the ALU 68 to provide converted data $Y=aX1+b$.

Thus, by storing the gradient data a and the Y-axis intercept data b in the constant ROM 63, the calculation $Y=aX1+b$ can be executed in significantly shortened step. Further, since the amount of data required for the conversion is small, only a part of the constant ROM 63 is used, without sacrifying the other data of filter coefficient etc. to be stored.

As mentioned above, according to this invention, the amount of data, to be stored in the memory used as a table for the data conversion, can be reduced and the calculation based on the data read out from the memory can be simplified. Consequently, high-speed data conversion with reduced number of program steps is realized. Further, the conversion error can be minimized, thereby providing digital processing with high accuracy.

In addition, since the processing load applied on the DSP can be lightened significantly, the audio signal processing apparatus for directional emphasis, conventionally performed by analog process, can be performed easily with high accuracy by digital process.

What is claimed is:

1. An apparatus for processing an audio signal with directional emphasis by providing another channel besides existing left and right channels in a stereo reproducing equipment, said apparatus comprising:

(a) a first block for outputting full-rectified digital signals comprising: a means for adding a left channel input digital signal Lin to a right channel input digital signal Rin, both being input at a predetermined sampling period, to generate a center channel digital signal; a means for subtracting the right channel input digital signal Rin from the left channel input digital signal Lin or vice-versa to generate a surround digital signal; a means for full-rectifying each of the left channel input digital signal Lin, the right channel input digital signal Rin, the center channel digital signal, and the surround channel digital signal;

(b) a second block for generating at least four types of coefficients corresponding to the right channel, the left channel, the center channel and the surround channel, to be multiplied by the left channel input digital signal Lin and the right channel digital signal Rin, from the digital signal output from said first block, said second block generating said four types of coefficients at a period increased a predetermined number of times of the sampling period of said first block; and (c) a third block for receiving the left channel input digital signal Lin and the right channel input digital signal Rin; for multiplying the left channel input digital signal Lin and right channel digital signal Rin by the at least four types of coefficients generated in said second block, therein generating a left channel output digital signal Lout, a right channel output digital signal Rout, a center channel output digital signal Cout, and a surround channel output digital signal Sout.

2. An apparatus according to claim 1, wherein said first block includes at least:

(a) a first adder means for adding the left channel input digital signal Lin to the right channel input digital signal Rin to generate a center channel digital signal C;

(b) a first subtractor means for subtracting the left channel input digital signal Lin from the right channel input digital signal Rin or vice-versa to generate a surround channel digital signal S;

(c) a first rectifier means for calculating an absolute value of the left channel input digital signal;

(d) a second rectifier means for calculating an absolute value of the right channel input digital signal Rin;

(e) a third rectifier means for calculating an absolute value of the center channel digital signal C;

(f) a fourth rectifier means for calculating an absolute value of the surround channel digital signal S.

3. An apparatus according to claim 2, wherein said first block further including at least:

(a) a first digital band pass filter means for eliminating unnecessary frequency component of the left channel input digital signal Lin which is input to said first adder means and said first subtraction means so as to generate left input digital signal L;

(b) a second digital band pass filter means for eliminating unnecessary frequency component of the right channel input digital signal Rin which is input to the first adder means and said first subtraction means so as to generate right input digital signal R.

4. An apparatus according to claim 2, wherein said second block includes at least:

(a) a first function converter means for applying a function conversion on the absolute value of the left input digital signal L output from said first rectifier means to output a digital signal Le;

(b) a second function converter means for applying a function conversion on the absolute value of the left input digital signal L output from said second rectifier means to output a digital signal Re;

(c) a third function converter means for applying a function conversion on the absolute value of the left input digital signal L output from said third rectifier means to output a digital signal Ce;

(d) a fourth function converter means for applying a function conversion on the absolute value of the left input digital signal L output from the fourth rectifier means to output a digital signal Se;

(e) a second subtractor means for subtracting the digital signal Re from the digital signal Le to output a level difference signal Le−Re;

(f) a third subtractor means for subtracting the digital signal Se from the digital signal Ce to output a level difference signal Ce−Se;

(g) a first digital low-pass-filter means for integrating the level difference signals Le−Re and Ce−Se;

(h) a level detector means for detecting the levels of the level difference signals Le−Re and Ce−Se based on the integrated value in said digital low-pass-filter means;

(i) a second digital low-pass-filter means having a time constant switching according to the output from said level detector means, and outputs a signal ELR from supplied level difference signal Le−Re;

(j) a third digital low-pass-filter means having a time constant switched according to the output from said level detector means, and outputs a signal ESC from supplied level difference signal Ce−Se;

(k) a polarity discriminator means for discriminating the signals ELR and ECS according to their polarity;

(l) an inverse-function converter means for inverse-logarithmically converting the output from said polarity discriminator means;

(m) a coefficient generating means for generating a plurality of coefficients based on the output from the inverse-function converter means.

5. An apparatus according to claim 4, wherein said first through fourth function converter means are logarithmic converters, and said inverse-function converter means is an inverse-logarithmic converter.

6. An apparatus according to claim 1, wherein said third block comprises at least:

(a) a multiplier means for multiplying the left digital signal L and the right digital signal R at each sampling period by the coefficient generated in said second block to generate a channel digital signal; and (b) a means for generating output digital signals of directionally accorded plural channels based on the channel digital signals generated by being multiplied by the coefficient.

7. An apparatus according to claim 2, wherein each of the first through fourth rectifiers means includes a digital lowpass-filter means acting as an integrator for the full-rectification and having a cut-off frequency of at least 14 Hz to prevent the interference of the sampling frequency from said second block.

8. An apparatus according to claim 4, wherein said third block includes at least:

(a) a multiplier means for multiplying the left digital signal L and the right digital signal R at the each sampling period by the coefficient generated in the second block to generate a channel digital signal;

(b) an output digital signal generator means for generating output digital signals of directionally accorded channels based on the channel signals generated by being multiplied by the coefficient.

9. An apparatus according to claim 5, wherein said third block includes at least:

(a) a multiplier means for multiplying the left digital signal L and the right digital signal R at the each sampling period by the coefficient generated in the second block to generate a channel digital signal;

(b) an output digital signal generator for generating output digital signals of directionally accorded channels based on the channel signals generated by being multiplied by the coefficient.

10. An apparatus according to claim 5, wherein each of said logarithmic converters means includes:

(a) a ROM containing data approximate to the logarithmic function curve for obtaining a variable Y representing the output data corresponding to the input data, said ROM: dividing a variable X representing the input data into X1, X2, X3, . . . Xn; approximating to the logarithmic function curve by using a group of lines Y=an X+bn which is formed by linking adjacent two points (Xn, Yn) and (Xn+1, Yn+1) on the logarithmic function curve corresponding to the divided variables X1, X2, X3, . . . Xn where n represents a whole number and a and b are coefficients;

(b) a calculating means for calculating the logarithmically converted values of the digital data L, R, C, and S, which are selectively input from said first block at each N times period of predetermined sampling period based on the approximate data of the logarithmic curve contained in said ROM, said calculating means including:

(i) a means for reading out, from said ROM, a1, a2, a3, . . . an and b1, b2, b3, . . . bn corresponding to the digital signals L, R, C, and S, supplied from said first block, as values of variable X; and (ii) a means for generating logarithmically converted digital data Le, Re, Ce, and Se, by executing an equation of Y=an X+bn, based on the data read out from the ROM.

11. An apparatus according to claim 5, wherein, each of said inverse-logarithmic converters includes:

(a) a ROM containing data approximate to the inverse-logarithmic function curve for obtaining a variable Y representing the output data corresponding to the input data, said ROM: dividing a variable X representing the input data into X1, X2, X3, . . . Xn; approximating to the inverse-logarithmic function curve by using a group of lines Y=an X+bn which is formed by linking adjacent two points (Xn, Yn) and (Xn+1, Yn+1) on the inverse-logarithmic function curve corresponding to the divided variables X1, X2, X3, . . . Xn where n represents a whole number and a and b represent coefficients;

said ROM containing data of: a1 and b1 corresponding to the range X1–X2; a2 and b2 corresponding to the range X2–X3; a3 and b3 corresponding to the range X3–X4; . . . an and bn corresponding to the range Xn−Xn+1; and (b) a calculating means for calculating the inverse-logarithmically converted values of the digital data supplied from said polarity discriminator means based on the approximate data of the inverse-logarithmic curve contained in said ROM, said calculating means including:

(i) a means for reading out, from said ROM, a1, a2, a3, . . . an and b1, b2, b3, . . . bn corresponding to the digital data supplied from said polarity discriminator means, as values of variable X; and (ii) a means for generating inverse-logarithmically converted digital data by executing an equation of $Y = an X + bn$ based the data read out from the ROM.

12. An apparatus according to claim 10, wherein the parameter n in establishing the range $Xn - Xn+1$ in said ROM is determined on base 2 ($n = 1, 2, \ldots N$).

13. An apparatus according to claim 12, wherein the data a1, a2, a3, . . . an and b1, b2, b3, . . . bn corresponding to the established range $Xn - Xn+1$ are stored in said ROM at addresses concerning $N - n - 1$ respectively; and these data are read out from said ROM by designating the addresses using the bit number which is the first "1" from the most significant bit of the input data.

14. An apparatus according to claim 11, wherein the parameter n in establishing the ranges $Xn - Xn+1$ in said ROM is determined on base 2 ($n = 1, 2, \ldots N$).

15. An apparatus according to claim 14, wherein the data a1, a2, a3, . . . an and b1, b2, b3, . . . bn corresponding to the established range $Xn - Xn+1$ are stored in said ROM at addresses concerning $N - n - 1$ respectively; and these data are read out from said ROM by designating the addresses using the bit number which is the first "1" from the highest bit of the input data.

16. A method for processing an audio signal with directional emphasis by providing another channel besides existing left and right channels in a stereo reproducing equipment, said method comprising the steps of:

(a) outputting full-rectified digital signals by completing a process comprising the following steps at each sampling period:

1) adding a left channel input digital signal Lin to a right channel input digital signal Rin, both being input at each of predetermined sampling period, to generate a center channel digital signal;

2) subtracting the right channel input digital signal Rin from the left channel input digital signal Lin or vice-versa to generate a surround digital signal; and 3) full-rectifying each of the left channel input digital signal Lin, the right channel input digital signal Rin, the center channel digital signal, and the surround channel digital signal;

(b) generating at least four types of coefficients corresponding to the right channel, the left channel, the center channel and the surround channel at a period increased a predetermined number of times of the sampling period of said step (a), and multipling said at least four types of coefficients by the left channel input digital signal Lin and the right channel digital signal Rin;

(c) receiving the left channel input digital signal Lin and the right channel input digital signal Rin; and (d) multiplying the left channel input digital signal Lin and right channel digital signal Rin by the at least four types of coefficients, therein generating a left channel output digital signal Lout, a right channel output digital signal Rout, a center channel output digital signal Cout, and a surround channel output digital signal Sout.

* * * * *